US008515721B2

(12) United States Patent
Morton et al.

(10) Patent No.: US 8,515,721 B2
(45) Date of Patent: Aug. 20, 2013

(54) METHOD FOR INTEGRATED INVERSION DETERMINATION OF ROCK AND FLUID PROPERTIES OF EARTH FORMATIONS

(75) Inventors: Kristy Morton, Rio de Janeiro (BR); Fikri Kuchuk, Meudon (FR); Richard Booth, Abingdon (GB); Mustafa Onur, Istanbul (TR)

(73) Assignee: Schlumberger Technology Corporation, Sugar Land, TX (US)

( * ) Notice: Subject to any disclaimer, the term of this patent is extended or adjusted under 35 U.S.C. 154(b) by 256 days.

(21) Appl. No.: 12/896,228

(22) Filed: Oct. 1, 2010

(65) Prior Publication Data

US 2011/0246161 A1 Oct. 6, 2011

Related U.S. Application Data

(60) Provisional application No. 61/272,507, filed on Oct. 1, 2009.

(51) Int. Cl.

| | |
|---|---|
| ***G06G 7/48*** | (2006.01) |
| ***G01V 1/40*** | (2006.01) |
| ***G01V 3/18*** | (2006.01) |
| ***G01V 5/04*** | (2006.01) |
| ***G01V 9/00*** | (2006.01) |

(52) U.S. Cl.
USPC ..... 703/10; 702/6

(58) Field of Classification Search
USPC ..... 703/13, 10; 702/6
See application file for complete search history.

(56) References Cited

U.S. PATENT DOCUMENTS

| | | | | |
|---|---|---|---|---|
| 7,526,418 | B2 * | 4/2009 | Pita et al. | 703/10 |
| 8,032,345 | B2 * | 10/2011 | Le Ravalec et al. | 703/10 |
| 2007/0005253 | A1 * | 1/2007 | Fornel et al. | 702/14 |
| 2008/0234988 | A1 * | 9/2008 | Chen et al. | 703/1 |
| 2009/0070086 | A1 * | 3/2009 | Le Ravalec et al. | 703/10 |
| 2010/0142323 | A1 * | 6/2010 | Chu et al. | 367/73 |
| 2011/0015912 | A1 * | 1/2011 | Oppert et al. | 703/10 |

OTHER PUBLICATIONS

Seongsik Yoon, NPL, "A multiscale approach to production-data integration using streamline models", 2001.*

* cited by examiner

*Primary Examiner* — Omar Fernandez Rivas
*Assistant Examiner* — Angel Calle
(74) *Attorney, Agent, or Firm* — Cameron R. Sneddon

(57) ABSTRACT

A method for determining rock and fluid properties of a fluid-containing subsurface geological formation is provided. First, a low resolution model of the geological formation is initially created from a lumped average parameter estimation derived from at least fluid pressure transient data obtained along a linear wellbore that traverses the formation. Next, the model parameters are updated using grid-based parameter estimation in which the low resolution pressure transient data are combined with data from at least one of seismic data, formation logs, and basic geological structural information surrounding the linear wellbore. Depending on the data available, this process may be carried out in a sequential manner by obtaining and combining additional dynamic data at selected areas. Through this process, multiple realizations of the properties of the geological formation (within the geological structural model) may be created based from the pressure-data conditioned geostatistics i.e. geostatistics that have been informed by data from both static and dynamic sources. Finally, the dynamic simulation of models should be compared to the results of the lumped average parameter estimation to provide a final calibration of the created models.

12 Claims, 13 Drawing Sheets

METHOD FOR INTEGRATED INVERSION DETERMINATION OF ROCK AND FLUID PROPERTIES OF EARTH FORMATIONS

CROSS-REFERENCE TO RELATED APPLICATIONS

The present application claims the benefit of U.S. Provisional Application No. 61/272,507, filed Oct. 1, 2009, which is incorporated herein by reference in its entirety.

TECHNICAL FIELD

The present invention generally relates to methods for pressure transient oil and gas well testing that employ wireline formation testers and permanent or semi-permanent pressure sensors either in the wellbore, such as DST, or in the formation. The invention is specifically concerned with a method for integrating low resolution pressure transient test analysis with higher resolution petrophysical, geological, and geophysical parameters to create constrained geostatistical realizations of a subsurface formation or reservoir.

BACKGROUND

In any subsurface hydrocarbon exploration and development, implied measurements such as detailed geological description and outcrop data, and specific measurements such as pressure transient, seismic, cores, logs, and fluid samples provide useful information for static and dynamic reservoir characterization, development of simulation models, and forecasting. However, core and log data delineate rock properties only in the vicinity of the wellbore while geological and seismic data usually are not directly related to formation transport properties such as permeability. Pressure transient data from drill stem testing (DST) or permanent downhole pressure sensors, production, and wireline formation tests provide dynamic data such as reservoir pressure and flow rate that can be used to estimate formation rock properties and fluid distributions and for dynamic reservoir description. Therefore, such tests are very useful for exploration environments and field development and reservoir management as well as for general production and reservoir engineering.

Conventional well tests such as DST have traditionally been used to obtain spatial distributions of the formation permeability and reservoir pressure based on the history matching of the pressure data to an analytical or a numerical model selected to best represent the flow regimes observed from diagnostic plots. In this application, this is referred to as a "lumped average" approach.

The most well-known lumped average techniques include the simple analytical model where the lumped parameters are mainly permeability-thickness product, permeability, skin factor, wellbore storage co-efficient and fracture length, etc. Recently, non-linear least-squares optimization has been applied to pressure transient data using numerical models with a similarly limited number of parameters.

As the need for more spatial resolution of the parameters increases, researchers have turned to "pixel" methods where the physical properties of the reservoir are discretized on a regular pixel-like grid over the reservoir domain. Such pixel based approaches have received considerable attention in the petroleum literature. The following publications disclose the application of techniques where dense geological information is used as a prior and regularizing scheme for an inversion:

Abacioglu, Y., Reynolds, A. C., and Oliver, D. S. (1997), "Estimating Heterogeneous Anisotropic Permeability Fields from Multiwell Interference Tests: A Field Example," 1997 *SPE Annual Technical Conference and Exhibition*, number SPE 38654, San Antonio, Tex., U.S.A.

Chu, L., Reynolds, A. C., and Oliver, D. S. (1995), "Reservoir Description From Static and Well-Test Data Using Efficient Gradient Methods," *International Meeting on Petroleum Engineering*, number SPE 29999, Beijing, P.R. China.

He, N., Reynolds, A., and Oliver, D. S. (1996), "Three-Dimensional Reservoir Description from Multiwell Pressure Data and Prior Information," 1996 *SPE Annual Technical Conference and Exhibition*, number SPE 36509, Denver, Colo., U.S.A.

He, N., Oliver, D. S., and Reynolds, A. C. (1997), "Conditioning Stochastic Reservoir Models to Well-Test Data," 1997 *SPE Annual Technical Conference and Exhibition*, number SPE 38655, San Antonio, Tex., U.S.A.

Oliver, D. S. (1996), "Multiple Realizations of the Permeability Field from Well Test Data," SPE *Journal*, June: 145-154.

Oliver, D. S., Reynolds, A. C., & Liu, N. (2008). *Inverse Theory for Petroleum Reservoir Characterization and History Matching*. Cambridge: Cambridge University Press.

Reynolds, A., He, N., Chu, L., and Oliver, D. (1996), "Reparameterization Techniques for Generating Reservoir Descriptions Conditioned to Variograms and Well-test Pressure Data," *SPE Annual Technical Conference and Exhibition*, number SPE 30588, Dallas, Tex., U.S.A.

The following publications have considered the inversion of production data on pixel-like grids:

Bi, Z., Oliver, D., and Reynolds, A. (2000). "Conditioning 3D Stochastic Channels To Pressure Data," *Society of Petroleum Engineers Journal*, December (4): 474-484.

Landa, J. L., Kamal, M. M., Jenkins, C. D., and Horne, R. N. (1996). "Reservoir Characterization Constrained to Well Test Data: A Field Example," 1996 *SPE Annual Technical Conference and Exhibition*, number SPE 36511, Denver, Colo., U.S.A.

Phan, V. Q. and Horne, R. N. (2002). Fluvial channel parameter estimation constrained to static, production, and 4D seismic data. In *SPE Annual Technical Conference and Exhibition*, number SPE 77518, San Antonio, Tex., U.S.A.

An alternative method of optimization for geostatistical parameters such as the correlation length and variance is discussed in:

Gautier, Y. and Noetinger, B. (1998). "Determination of Geostatistical Parameters Using Well Test Data," In *SPE Annual Technical Conference and Exhibition*, number SPE 49278, New Orleans, La., U.S.A.

Yadavalle, S. K., Roadifer, R. D., Jones, J. R., and Yeh, N.-S. (1994). "Use of Pressure Transient Data to Obtain Geostatistical Parameters For Reservoir Characterisation," *69th Annual Technical Conference and Exhibition*, number SPE 28432, pages 719-732, New Orleans, La., U.S.A.

The following publications disclose ensemble Kalman filtering techniques applied to pixel-like grids:

Aanonsen, S. I., Naevdal, G., Oliver, D. S., Reynolds, A. C. and Valles, B. (2009). Review of ensemble Kalman filter in petroleum engineering (SPE 117724), SPE Journal, 14(3), 393-412.

Evensen, G. (2007). Data Assimilation: The Ensemble Kalman Filter, Springer, Berlin.

The following publications should be considered as background art related to sensitivity and uncertainty analysis in pixel-based methods:

Booth, R. J. S., Morton, K. L., Onur, M., Kuchuk, F. J. (2010). Grid-based Inversion of Pressure Transient Test Data, presented at 12th European Conference on the Mathematics of Oil Recovery, Oxford, UK, 6-9 September (incorporated herein by reference).

Farmer, C. L. (2007). Bayesian field theory applied to scattered data interpolation and inverse problems; Algorithms for Approximation, 147-166.

BRIEF DESCRIPTION OF THE DRAWINGS

Implementations of the invention may be better understood when consideration is given to the following detailed description thereof. Such description makes reference to the annexed pictorial illustrations, schematics, graphs, drawings, and appendices. In the drawings.

DETAILED DISCLOSURE

Figure 1:
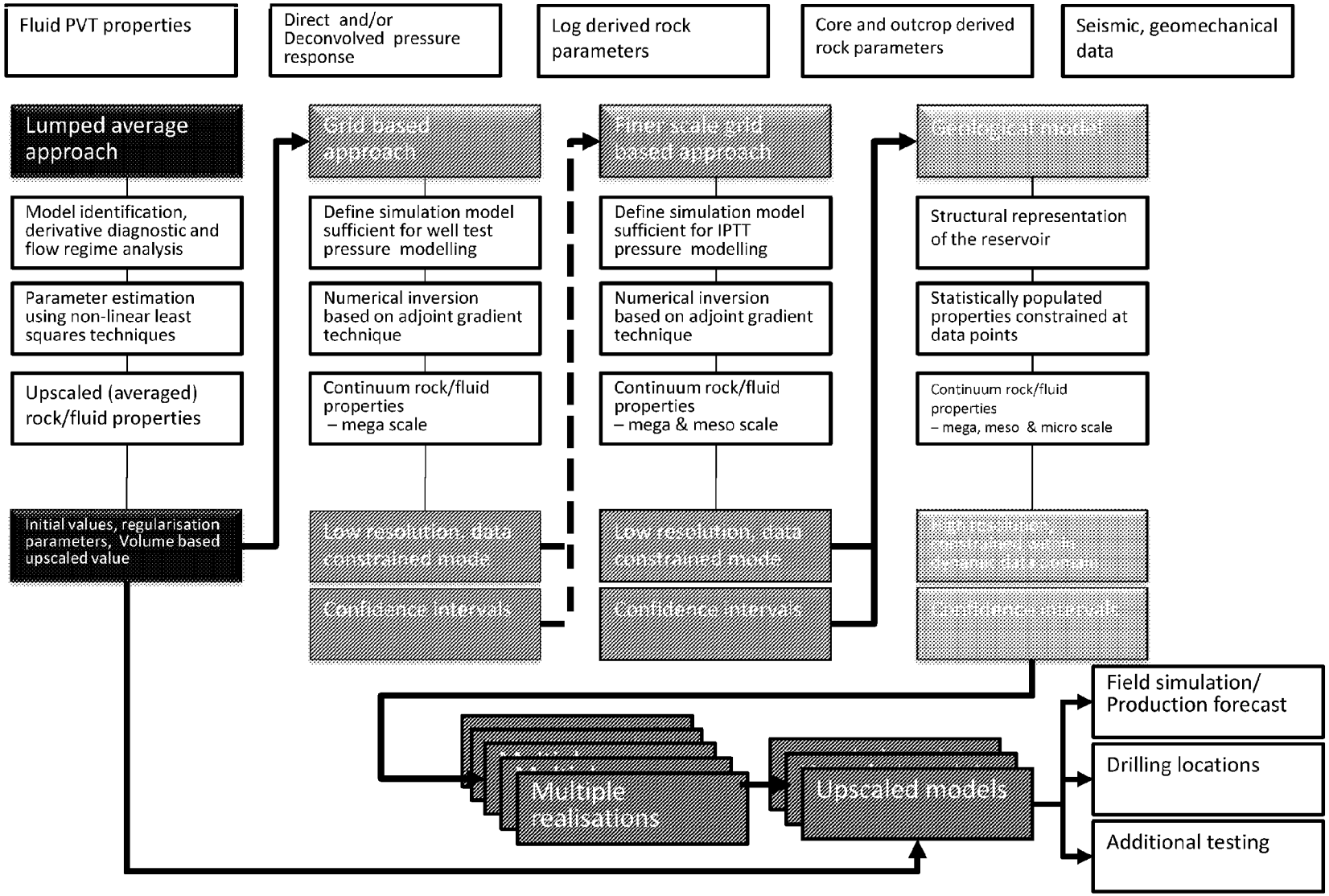
In FIG. 1, a schematic representation of a flow chart depicting a method of the present invention as disclosed herein.

Generally, the invention is a grid-based method for determining rock and fluid properties of a subsurface geological formation which is distinguished from the above-cited work in that the grid itself can be arbitrary, grid block sizes can vary throughout the domain, and which obtains the required gradients in a numerically efficient way. To these ends, a low resolution model of the geological formation is initially created from a lumped average parameter estimation derived from at least pressure transient data obtained along a linear wellbore that traverses the formation. The model parameters are updated using grid-based parameter estimation in which the low resolution pressure transient data are combined with data from at least one of seismic data, formation logs, and basic geological structural information surrounding the wellbore. Depending on the data available, this process may be carried out in a sequential manner by obtaining and combining additional dynamic data at selected formation locations. Through this process, multiple realizations of the properties of the geological formation (within the geological structural model) may be created based on the pressure-data conditioned geostatistics, i.e. geostatistics that have been informed by data from both static and dynamic sources. In a preferable embodiment, the dynamic simulation of models should be compared to the results of the lumped average parameter estimation to provide a final calibration of the created models.

In pressure transient testing, a fluid is produced (or injected) from a porous medium (reservoir or aquifer) by several wells and the pressure response due to fluid production may be monitored along each wellbore and also at other sites. The acquired data at the surface and or downhole from these wells may include all or some of these measured quantities: transient pressure, flow rates for all phases, and temperature (these quantities are called dynamic data) as functions of time. The objective of pressure transient testing is to provide dynamic data for well productivity and a description of the well/reservoir system with other available static and dynamic data from the wells in the reservoir.

Traditionally, if there is a reasonably good description of the reservoir, or if only a very crude description of the reservoir is desired, it may be possible to characterize the reservoir in terms of a small number of parameters. In such cases it is natural to apply nonlinear optimization schemes to find the optimal value of these parameters. Such parameters can often be considered to give an average of the true properties within the volume of investigation of the test.

When there is limited a priori information available to describe the reservoir, and a fairly detailed description of the reservoir is desired, one is led to consider a "pixel-based" approach, in which the physical properties of the reservoir are discretized on a pixel-like grid. This leads to an extremely large number of parameters as the grid is refined.

However, as the number of parameters increases it becomes computationally more costly to apply nonlinear optimization algorithms, because an evaluation of the forward model for nonlinear optimization at each time step must be performed to calculate the gradient of a functional with respect to each parameter. In this application, a variational approach is described that provides a numerically efficient method for obtaining gradients required in an optimization algorithm. The optimization algorithm and technique of the present invention provide a low-resolution, maximum-likelihood image of reservoir properties. This realization is based on limited prior information about the reservoir using a local Gaussian random field. This enables one to rule out physically unlikely solutions and to determine the 'most likely' physical solution when several descriptions (models) provide an equally good fit with the data. The local Gaussian field gives a more limited description of the statistics compared to a general Gaussian field in that a two-point correlation is assumed that is only a function of some measure of the distance between the two points. However, this allows for interblock grid distances to be varied which in turn allows the discretized model to more accurately capture the pressure transient created by production from a well(s) and acquired at the surface or downhole in wells including observation wells.

The mode or state of maximum posterior probability (i.e. 'the most likely' description) for the discretized parameters is often presented as the final answer in the analysis. However, this state alone is insufficient as it says little about the remaining uncertainty in the inversion or how the pressure data has added to the state of knowledge of the complete system. For the outcome of the test to contain more information than a constrained deterministic history match, the posterior probability distribution must be defined that provides a "confidence interval" or sensitivity for each grid cell with respect to the observed data.

In one embodiment, multiple drastically-different reservoir models may be matched to the measurement history. The method applied in such embodiment allows one to seek out these multiple scenarios and produce a multimodal posterior probability distribution, with a probability that may be associated with each scenario. In a multimodal extension, different initial guesses may be considered to see if they all ultimately converge to a similar reservoir field. If not then there may be multiple scenarios. Relative likelihood may be described by finding multiple local minima and finding their local covariance/confidence interval.

A confidence interval, or even a more complete description of the posterior covariance, can be found as a result of approximation of the second derivative of the likelihood in the neighborhood of the maximum-likelihood reservoir description. Such an approximation may be obtained automatically as part of the quasi-Newton schemes that are used to locate the maximum-likelihood reservoir description. The confidence interval approach may be effective whenever the posterior probability distribution is approximately Gaussian, or multimodal with an approximate Gaussian distribution in the vicinity of each mode. We can determine whether or not the posterior probability distribution deviates significantly from the Gaussian by examining the convergence of the quasi-Newton scheme. We have developed a secondary approach—the Langevin method—for modeling uncertainty when we believe that a Gaussian model is insufficient. The Langevin method can sample from any nonlinear posterior probability distribution, and is based on ideas suggested in Farmer (2007).

The integrated approach described in this application for the determination of formation rock and fluid properties takes the lumped parameter approach as a starting point. The lumped average parameters are combined with data from formation logs and basic structural information from geology and seismic to provide an initial state (permeability, porosity, dual porosity parameter, faults and fracture, model structure) for a coarse scale grid based model of parameter estimation from pressure transient test data. Following a numerical optimization using the variational techniques outlined, the coarse scale grid based model is downscaled to include finer scale gridding. The mode and posterior distribution from the coarse model act as the initial state for a finer scale grid based parameter estimation for a smaller scale pressure test such as wireline formation testers. Several downscaling steps can be nested together to cover data from layer by layer DST, distributed pressure measurements, interval pressure transient tests and formation sampling. The level of refinement will depend upon the data available. Once the available dynamic data are incorporated, the resulting model is downscaled by one further step. In this step, the mode and posterior distribution conditioned to all dynamic data provide the prior for the geological model. Volumes with a low degree of confidence/high variance from pressure data can be refined using geostatistical methods and high-confidence and low-resolution features observed in the dynamic data mode can be resolved with additional information (such as fracture distributions postulated from petrophysical, geological, and/or geomechanical models).

When the underlying posterior probability distribution cannot be approximated either locally or globally by Gaussian distributions, it may not be possible to consistently include additional geological information. Under such circumstances it will be necessary to rematch the pressure transient data as new structural information from geology or seismic becomes available, for example from samples that may have already been found.

Multiple realizations of the geological model are prepared to allow for variability in the model where there is low confidence. For practical usage, several models (often volume based P10, P50, P90) are selected for upscaling. Following the upscaling process, the original pressure transient test is simulated and the pressure response analyzed using the lumped parameter techniques. The upscaled models are further verified by comparison of the observed data lumped parameters compared to the lumped parameters derived from the model. At the end of the process, a full field dynamic simulation model has been prepared that has been conditioned to all available dynamic data and static geoscience data. In addition, the upscaling process from fine to coarse scale has been validated by comparison to the results obtained from a lumped average pressure transient test analysis.

The final step in the workflow concerns the inclusion of future measurements at a later stage of field life. At this stage, a geological model has been created that is pre-conditioned to pressure transient test data and smaller scale distributed pressure measurements or interval pressure transient tests (IPTT) from wireline formation testers. It is unnecessary to rerun the entire workflow to incorporate data as new pressure transient measurements become available. In this case, the pre-conditioned geological model is used as a prior for a Levenberg-Marquardt optimization using methods outlined by Oliver et al (2008). If the number of additional measurements becomes larger, one should consider the application of ensemble Kalman filtering (EnKf) techniques (Evesen 2007; Aanonsen et al 2009).

In one embodiment, the methods described herein may be incorporated into a computer program on a computer-readable medium and executable by a computer to perform the methods. One example of a computer program may include PETREL™ seismic to simulation software by Schlumberger.

In FIG. 1 the integrated data analysis method is described. In an exploration well situation or early appraisal well, the geological knowledge may be limited. This method involves sequentially conditioning models with all available dynamic data using a downscaling process. Once all dynamic data are incorporated, the image of the reservoir is further resolved by the addition of geological data and by providing statistically distributed parameters where data confidence is low. Multiple realizations are created. Upscaling to a coarse model may be required depending on the size of the conditioned geological model. The upscaling process is validated by comparing the lumped parameter estimated from a pressure transient test of the model with the lumped parameter estimate of the observed data. The starting point of the methodology is to perform a lumped average parameter estimate to provide an initial broad understanding of the geometry and properties of the tested reservoir. The process is described below.

Lumped Average Parameter Estimation

Following a pressure transient test, exemplary pressure transient test methodology, as disclosed in US 2010-0076740, filed Sep. 8, 2009, entitled "SYSTEM AND METHOD FOR WELL TEST DESIGN AND INTERPRETATION" and owned by Schlumberger, should be applied to prepare and condition data received from all pressure measuring devices available. The entire disclosure of US 2010-0076740 is hereby incorporated in this disclosure by reference.

The models available to estimate properties from the flow regimes observed in reservoirs such as fractured carbonate reservoirs are limited. For example, analytical reservoir models with conductive fractures are applied to analyze cases where fractures are connected to the wellbore and anisotropic numerical models can be used to allow for a preferential flow direction deeper in the reservoir. These models are based on a few lumped average parameters such as fracture conductivity and fracture length and as a result give a very low resolution image of the reservoir.

Due to the small number of parameters, nonlinear optimization techniques can be applied to find the optimal value of these parameters. However, it should be noted that the choice of model and thus the lumped parameters is initially driven or constrained by the geological understanding of the formation, i.e., there is a risk that the model itself is incorrect.

The parameter estimates derived by deterministically fitting an analytical (or simple numerical) solution to the pressure response of a pressure transient test is an average of a highly lumped reservoir volume. In the following grid based approach the volume of influence that should be related to these parameters is presented.

Grid Based Parameter Estimation

The method for grid based parameter estimation is disclosed. When referring to a parameter, applicants imply any formation rock and/or fluid, and/or well property that does not vary with time (during the application of the technology). A structured or unstructured grid can be selected to accurately model the pressure transient behavior and resolve the reservoir parameters. An adaptive grid may also be selected.

The starting model, $m_0$, is selected and accommodates any known a priori information. The parameters are considered to vary according to a local Gaussian random field. The field has a probability density functional of the form, $$\pi[u]=C\exp(-H[u]) \tag{1}$$

where for a local Gaussian random field H[u] is typically of the form $$H[u]=\tfrac{1}{2}\int_\Omega a_2(\nabla^2 u)^2+a_1|\nabla u|^2+a_0u^2dx \tag{2}$$

An example of a description of the reservoir model and well parameters is $$\pi[k_x,k_y,k_z,\phi,\rho_0,C_j,s_j]=\pi[k,\phi]\pi[\rho_0]\Pi_{j=1\ldots N_w}(\pi[C_j]\pi[s_j]) \tag{3}$$

where $k_i$ refer to log permeability in each direction, $\phi$ is the porosity, $C_j$ is the wellbore storage coefficient, and $s_j$ is skin.

The log-permeability in each direction and the log-porosity are distributed about some mean value according to a local Gaussian random field of the form given in (2). Equation (2) may also be modified to allow for correlation between these parameters. The initial pressure profile is also distributed about a mean value of the initial pressure with a local Gaussian random field as given by (2). The wellbore-storage coefficients may be assumed to be log-normally distributed. Many options are available for the prior model of the skin coefficient, with the possibility of treating the skin coefficient as either constant for each wellbore, or to be described by a one-dimensional local Gaussian random field.

It is desirable to obtain agreement between the most likely fields of rock, fluid and well parameters and the pressure measurements that are available over time at each of the $N_w$ wells and observation points and whatever (limited) prior knowledge is available of the reservoir. It is expected that there are some errors in the pressure measurements, and analysis of these errors will give an indication of when it is more appropriate to use what prior knowledge is available rather than the results of the pressure measurements.

Using Bayes' theorem, the conditional probability density functional for $\alpha$, a random vector of pressure measurements, and $\chi$, the random vector of subsurface parameters are all defined. The set of oilfield parameters that are of maximum likelihood given the available pressure measurements can then be found by maximizing the log-likelihood function $$L^*[\chi]=\log(\pi[\alpha^*|\chi])+\log(\pi[\chi])-\log(\pi[\alpha^*]) \tag{4}$$

The model of the pressure measurement term for discrete, independent pressure measurements with normal errors can be expressed as $$\log(\pi[\alpha^* \mid \chi]) = -\frac{1}{2}\sum_{i,j}\frac{(p_{w,i,j}[\chi]-P_{w,i,j})}{\sigma_{i,j}^2}+\text{constant}, \tag{5}$$

where $\rho_{w,i,j}[\chi]$ and $P_{w,i,j}$ are the model and measured pressures at the jth well at the ith time step and $\sigma_{i,j}^2$ is the variance of the error made when measuring the pressure in the jth well at the ith time step.

The term $\log(\pi[\chi])$ is simply the logarithm of the probability density functional given by (3). As a simple illustrative example, for an isotropic reservoir with a known mean permeability $\bar{\chi}$, and known porosity, initial pressure, wellbore-storage coefficients and skin coefficients, this term is given by $$\log(\pi[\chi])=-1/2\int_\Omega(\chi(x)-\bar{\chi})\cdot(a_2\nabla^4-a_1\nabla^2+a_0)(\chi(x)-\bar{\chi})dx \tag{6}$$

The inverse problem is then to obtain the parameter which maximizes the log-likelihood function by substituting in the expressions for the measurement and prior model probability functions. Equivalently, the objective function given by the negative of the log-likelihood function should be minimized.

The minimum of the objective function can be found using the steepest descent method, conjugate-gradients, or one of various quasi-Newton methods such as BFGS or LBFGS as disclosed in Nocedal, J., and Wright, S. J. (1999), *Numerical Optimization*, (Springer Verlag).

Each of these methods requires an evaluation of the sensitivity of a parameter to the objective function. The sensitivity of the objective function to a particular parameter is found from the derivative of the variation of the response function. However, to produce the sensitivity of the objective function to the parameters, the forward model must be run once for each parameter as a forward model links the pressure response to the parameters. The introduction of an adjoint variable relaxes the constraint between the pressure and the parameters so that the sensitivity of the objective function to the parameters can be more easily obtained. To evaluate this sensitivity, the solution to the adjoint problem must be found in addition to the forward problem (Oliver et al, 2008, id.).

With all of the gradients calculated for each parameter of interest using the adjoint method, we present a new algorithm for finding an optimal solution of the inverse problem. First one starts with an initial state for the parameters. The following steps are then carried out:

1. Solve the forward problem with respect to the initial and boundary conditions.
2. Solve the adjoint problem with respect to the boundary conditions.
3. Calculate the gradient of the objective function with respect to each parameter assuming that the local Gaussian field model is applicable.
4. Determine the search direction using the gradient (steepest descent method) and previous search directions (conjugate-gradient and quasi-Newton methods).
5. Apply a one-dimensional numerical minimization, such as a line search or the secant method to minimize the objective function in the search direction.
6. Return to step 1 using the new state obtained from step 5.

During the execution of step 5, a split implicit-explicit procedure may be applied with the linear part of the gradient (from the prior model) represented implicitly. This approach is useful for improving the stability of the optimization technique and thereby allowing larger steps to be taken in the line search. As shown in (Nocedal & Wright, 1999) the quasi-Newton methods BFGS and L-BFGS allow a representation of the second derivative, and thereby approximate the posterior covariance matrix, by storing a limited number of approximations to the true set of parameters and corresponding objective gradients for these solutions. For the quasi-Newton methods the split implicit-explicit procedure is equivalent to representing the second derivative of the posterior likelihood as the sum of the second derivative of the prior likelihood and another term which is modeled by the quasi-Newton method in the usual manner. The method outlined above provides a robust procedure for determining the approximate images of reservoir permeability, porosity etc. based on interference pressure data among the wells.

Advanced Prior and Variance Modeling

The above procedure takes a concrete prior model of the reservoir. In practice the prior model is typically constructed from limited knowledge from previously known analogue reservoirs. The construction of this model allows the reservoir to be characterized by a small number of 'hyperparameters' (for example the correlation length scales for the permeability) that are distributed over a narrow range. The procedure allows for the exact value of these hyperparameters in the reservoir under testing to be treated as unknown with a known prior distribution function, and such modeling helps to reduce the bias generated by a poor choice of a prior model. The procedure also requires the determination of a concrete value for the variance of the errors in pressure measurements, yet an accurate value of this variance is not always available. Moreover there is no certainty that the forward modeling has no errors. The error variance at each sensor may therefore be treated as an additional set of parameters. For optimal performance a prior for the variance should be given centered around the estimated error variance of the pressure sensors.

Both of these procedures reduce the bias that may be generated by assumed values for these difficult-to-estimate prior parameters. The local prior-model for reservoir parameters allows a description to be made of the reservoir with a small number of hyperparameters, and so this extension is particularly well-suited to the procedure that was outlined in the previous section.

Sampling from Nonlinear Posterior Distributions

When quasi-Newton methods are applied to a posterior distribution that is not well-represented by a Gaussian approximation convergence will be slower than would otherwise be expected. Furthermore the second derivative is not sufficient for sampling. We advocate the Langevin method, first proposed in Farmer (2007), as an alternative approach which directly samples from the posterior. The Langevin method requires the addition of random noise in the steepest descent method; however, second derivative information obtained using e.g. the BFGS or L-BFGS approach, could also be used to enhance the rate of convergence. The method is superficially similar to both simulated annealing and particle filtering methods, but differs from simulated annealing in that it produces samples of the posterior and from standard particle filtering methods in that it employs gradient information to improve convergence. The use of a split implicit-explicit scheme may be particularly important for the Langevin method.

Nested Downscaling

Figure 2:
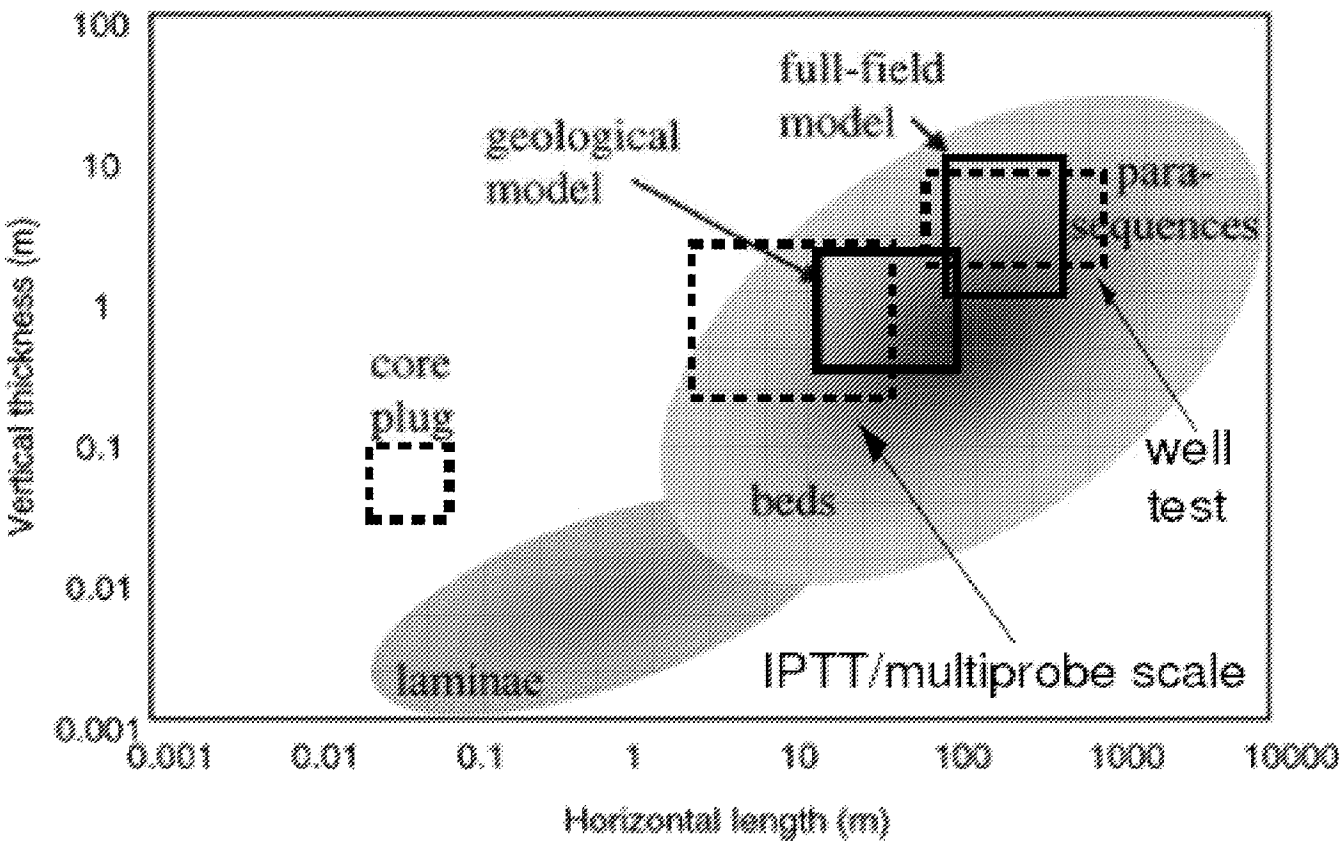
FIG. 2 illustrates the multiple scales of dynamic and geological data available for modeling subsurface formations.

FIG. 2 illustrates the length scales apparent in clastic (sandstone) geological formations (a similar plot could also be prepared for carbonate reservoirs etc.) and the measurement scale of dynamic and static measurements. It is clear that pressure transient test data capture a particular scale but may not resolve the finer scale features. Thus, to improve the resolution, the model is downscaled by increasing the number of grid cells to sufficiently model the response of an IPTT or distributed pressure sensors.

The maximum posterior likelihood solution from the grid-based approach may be transported to a finer grid by interpolation. The posterior covariance may be transported to the finer grid by interpolating the approximations of the true parameters and gradients stored for the quasi-Newton approximation of the covariance matrix.

It should be noted that this approach may also be applied to the general analysis of IPTT (sink and offset vertical probe) and with some modification to the horizontal probe.

Geological Integration Methodology

The final integration step is to downscale from the dynamically conditioned, low resolution grid to a full geological model. The geological description is expected to be constructed from, but not limited to, data from seismic and geological interpretation to provide reservoir structure, petrophysical and core data to provide distributions of rock properties and additional spatial distribution of geological properties from outcrop or advanced seismic inversion techniques. The process of downscaling to the geological model improves the parameter distribution in areas unconstrained by pressure transient test data by including spatial variation that is observed in the geological description. In addition, more data may be included in the model by allowing the geologist to refine features observed on dynamically conditioned model if they make sense geologically. The pressure-derivative data should also be used to infer the type of geological features (fractures, sedimentary features).

The above procedure can be applied to understand where pressure measurement updates the knowledge of the parameters and reduces the uncertainty in the rock and fluid properties by a significant level. Grid cells that are well informed by the pressure data are weighted strongly in the downscaling/extrapolation process which retains the information determined from the pressure transient test. Multiple realizations of the final geological model are created through standard processes which are constrained by the pressure transient test data.

Upscaling Verification

Standard oilfield practices require that the fine scale geological data (transport properties of each grid) must be upscaled to allow for efficient and timely simulation runs. This process is highly dependent upon the geology of the formation and choice of upscaling methodology. In this respect, the lumped parameter estimates obtained at the start of the process act as a final verification of the upscaling process and of the veracity of the model itself. After the chosen upscaling method is applied, a pressure transient test is performed on the model. The lumped average parameter estimation of the test should match the observed data parameter estimation to validate the choice of upscaling algorithm and the conditioned model itself.

Incorporating Additional Data

The final step in the workflow concerns the addition of more data as measurements taken at a later stage in field life to the above models. At this stage, a geological model has been created that is pre-conditioned to pressure transient test data and smaller scale distributed pressure measurements or interval pressure transient tests (IPTT). It is unnecessary to rerun the entire workflow to incorporate data from new wells. In this case, the pre-conditioned geological model is used as a prior for a Levenberg-Marquardt optimization using methods outlined by Oliver et al (2008, id.) These techniques are appropriate where a good guess of the geological model is available or the number of additional measurements is low. If the number of additional measurements becomes larger, one should consider the application of ensemble Kalman filtering techniques (Evesen 2007; Aanonsen et al 2009).

Example of the Process

No single measurement can completely characterize a reservoir. Hence measurements at downhole and/or surface taken over a range of scales and locations are relied upon to generate as complete a picture of the reservoir as possible. Integrating the results of core plugs, log measurements, IPTT, distributed pressure sensors, pressure transient tests and seismic data allows the parameters of the reservoir to be more accurately determined and verified.

Figure 3:
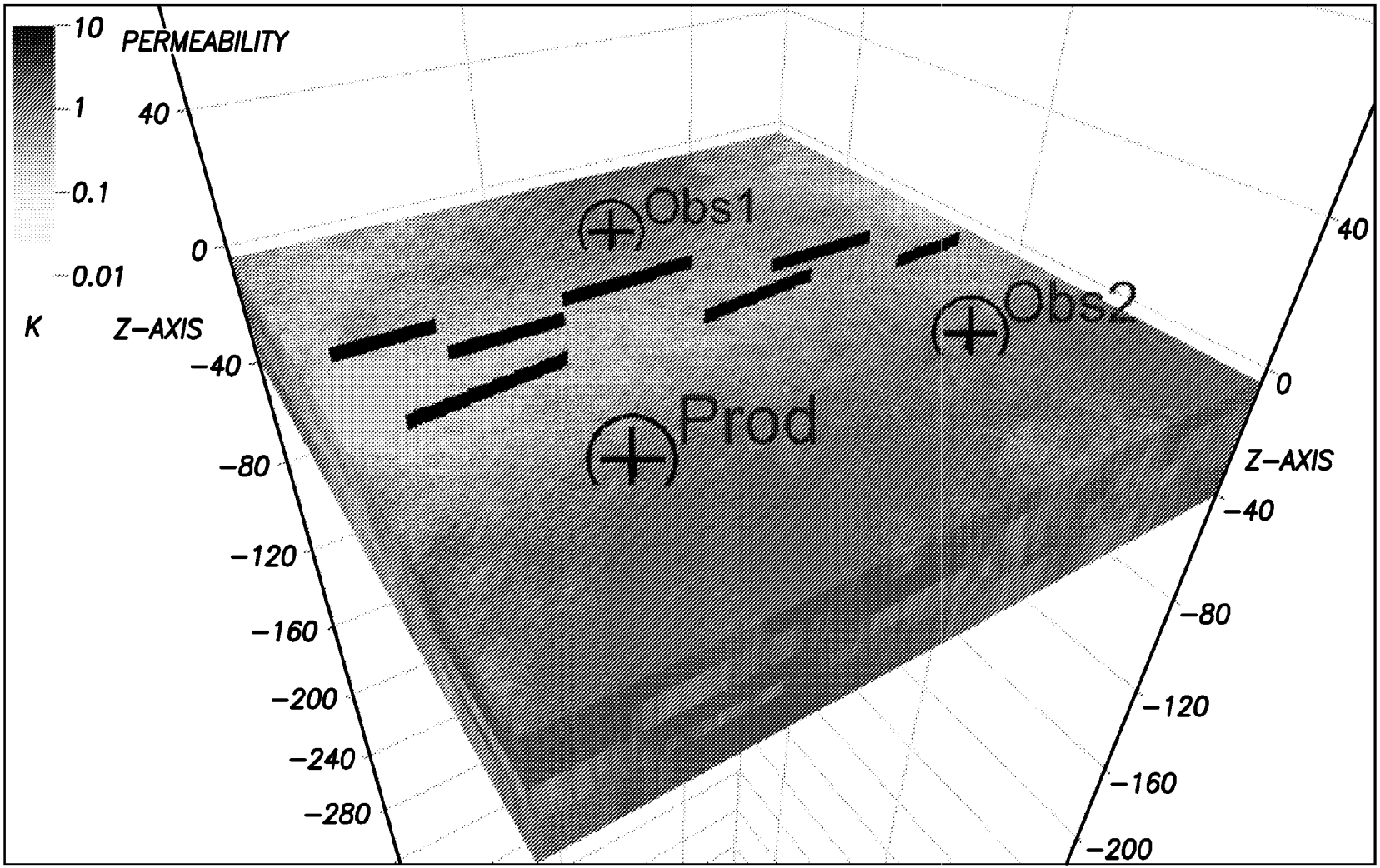
FIG. 3 illustrates an exemplary geological model incorporating discrete fractures.

An exemplar geological model is shown in FIG. 3: a producer well prod and two observation wells, obs1 and obs2, are placed in the model. FIG. 3 will be considered as the true model or real reservoir.

Figure 4:
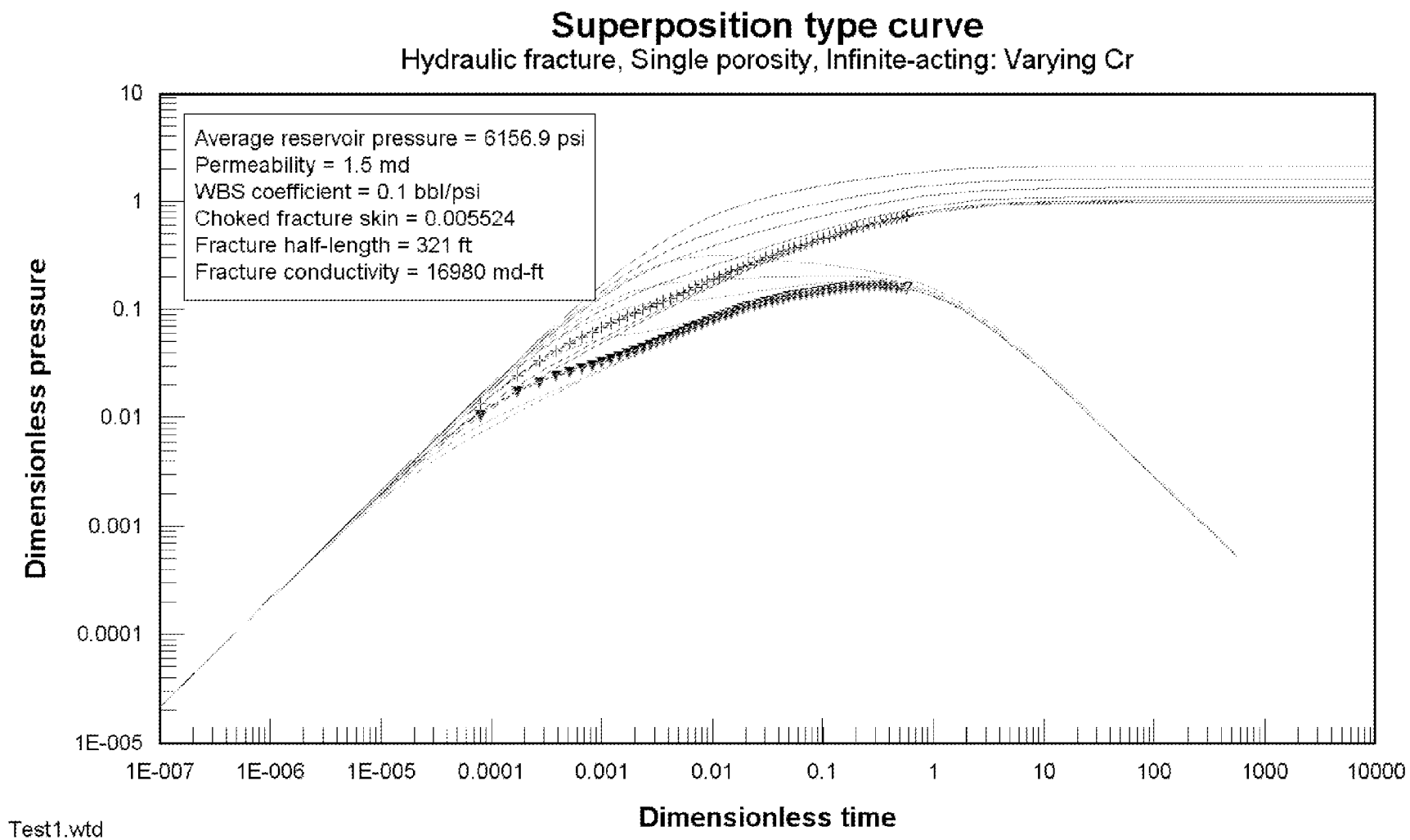
FIG. 4 illustrates an exemplary history match performed for a limited number of parameters obtained by application of standard analytical lumped average method.

FIG. 4 shows the lumped average pressure match that is obtained from a nonlinear least squares match of the pressure response of a pressure transient test performed on well p in the true model as shown in FIG. 3. The average properties obtained from the lumped average process is used as the prior for the first stage grid based numerical optimization of the pressure transient test data.

Figure 5:
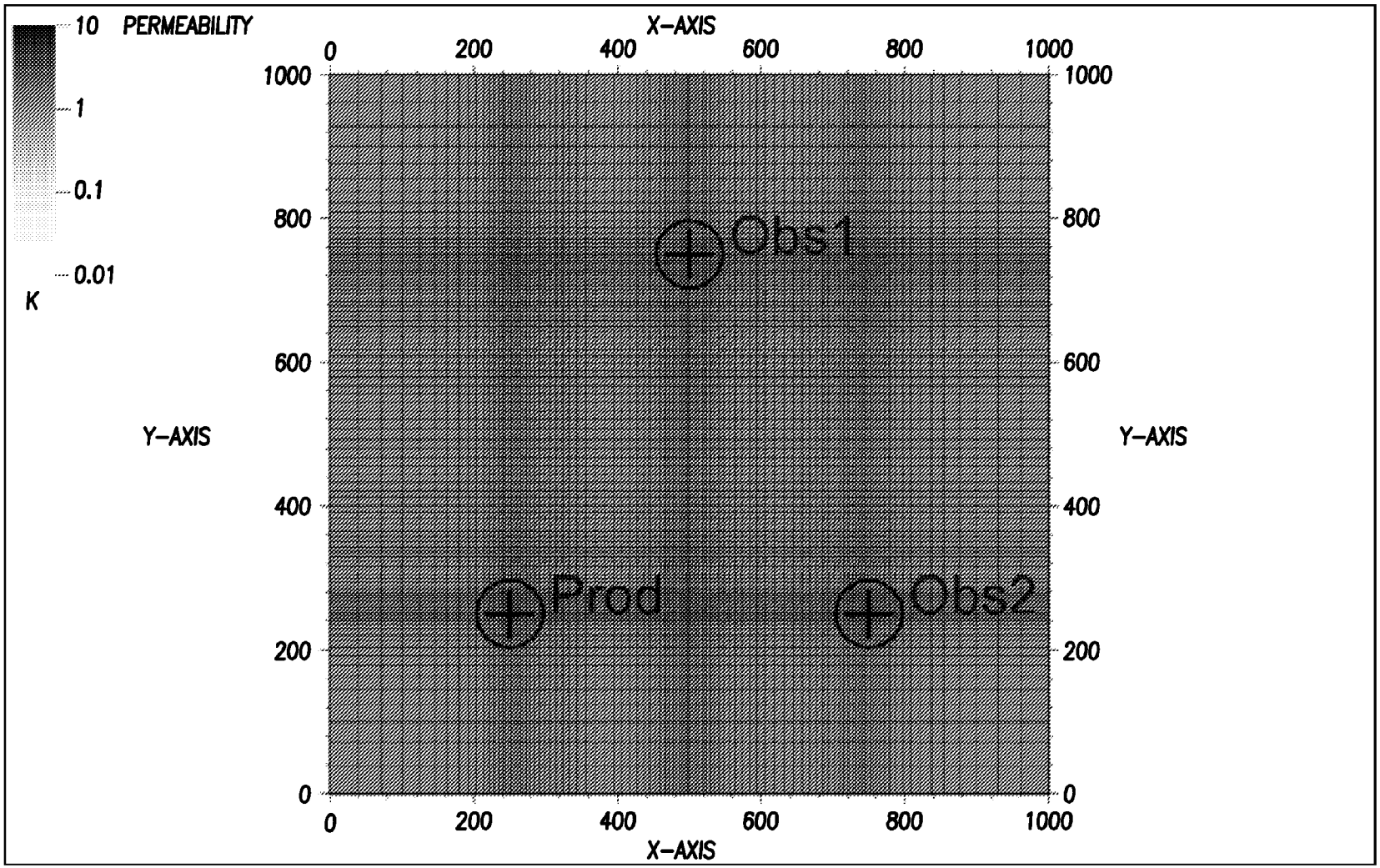
FIG. 5 illustrates a schematic, aerial-sectional view of observation wells offset horizontally from the tested well and the initial state populated from the lumped averaged analysis. Note the irregular gridding required to accurately capture the pressure transient response.
Figure 6A:
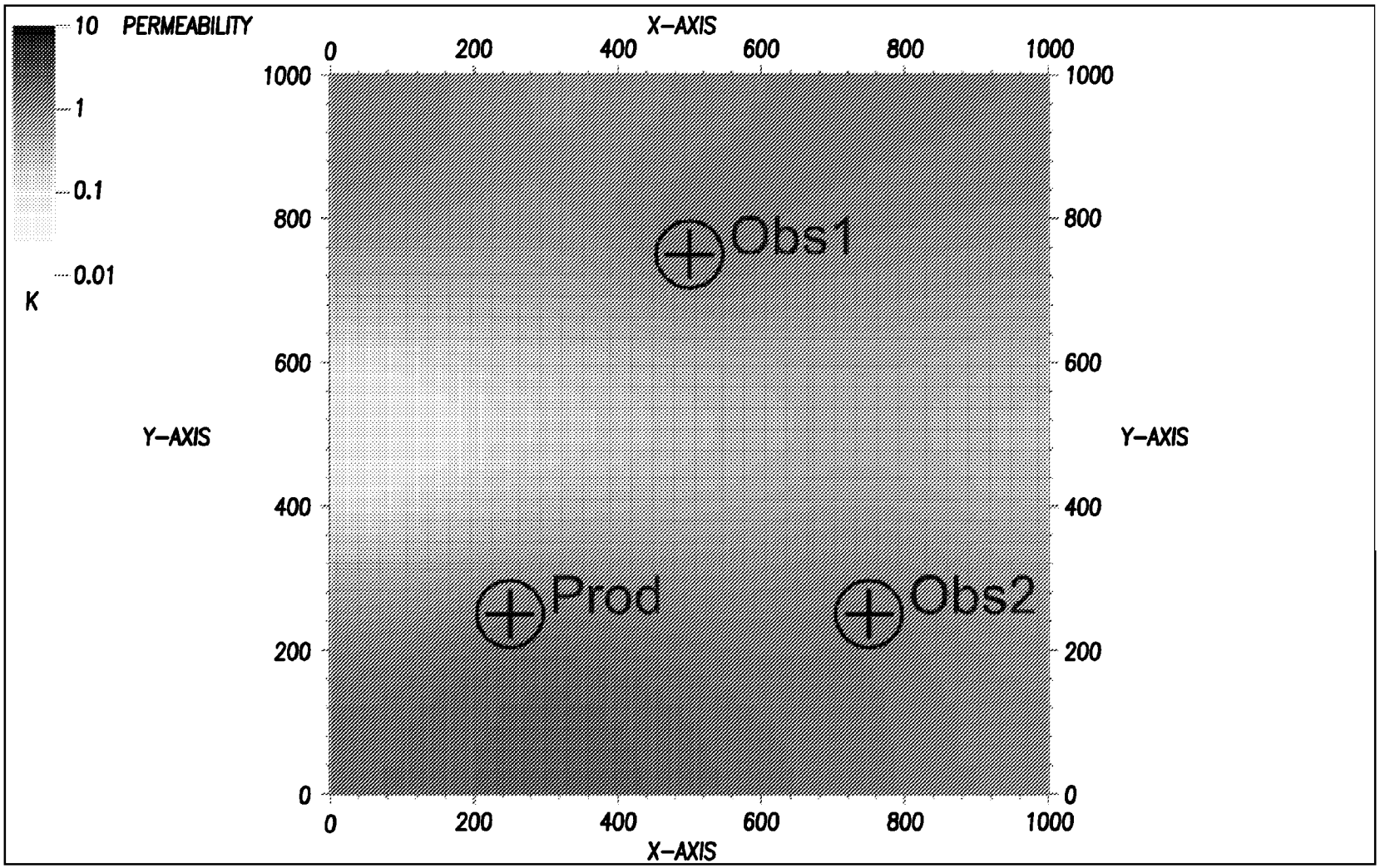
FIGS. 6A and 6B illustrate plan and perspective views a 3D low resolution image of the reservoir obtained by application of the first aspect of this invention to the measurement points shown in FIG. 5.
Figure 6B:
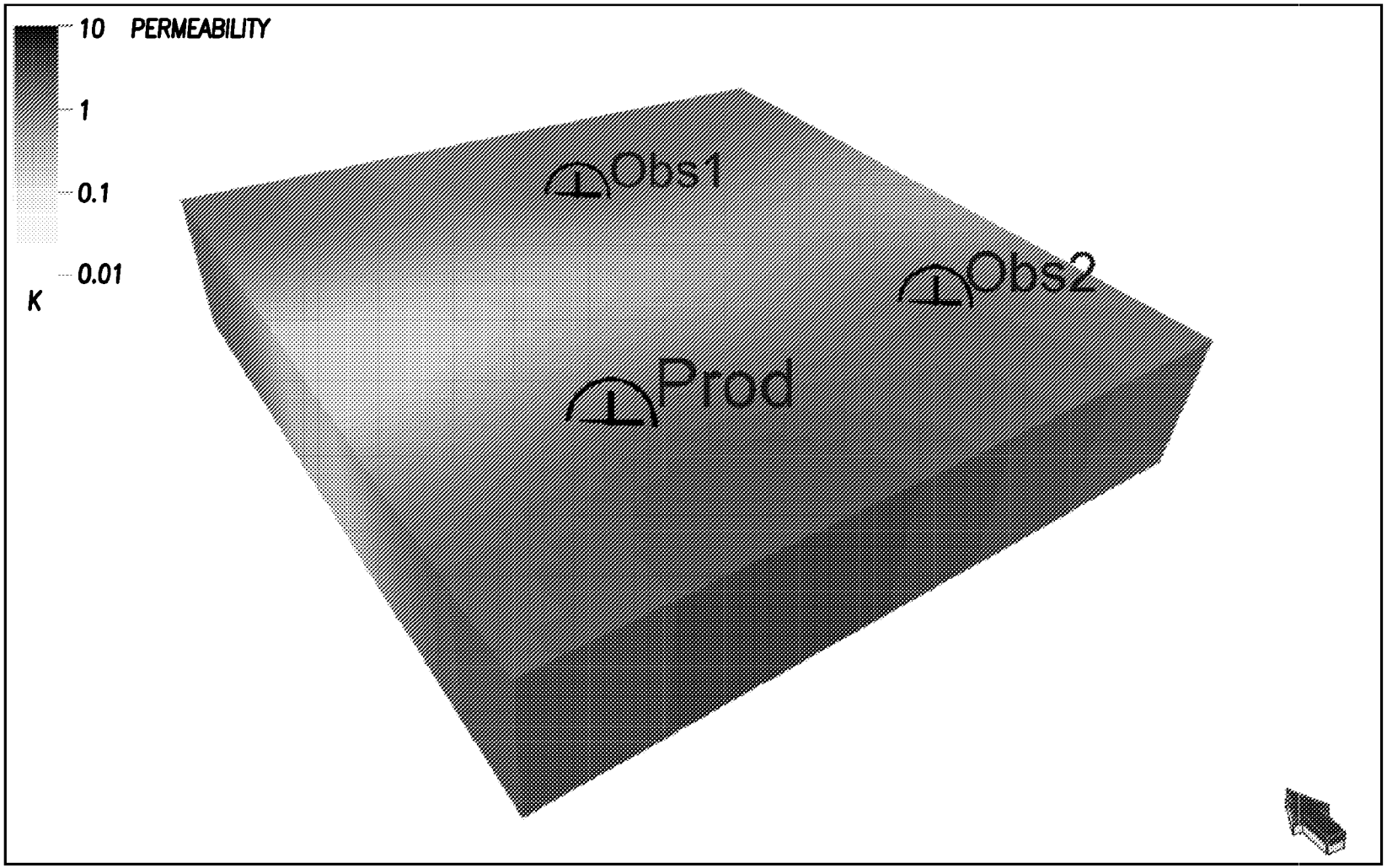

In FIG. 5 and FIG. 6 the performance of the grid based algorithm is demonstrated at a coarse scale. The initial state showing the average permeability from the lumped average approach and well positions are indicated in FIG. 5. The wellbore parameters (wellbore storage coefficients, skin) from the lumped average analysis are incorporated in the well model. Fluid is produced from well prod and the pressure is observed at well obs1 and obs2. To simulate the measurement noise that is present in real data, random noise with a known standard deviation is added to the synthetic data. FIG. 6 shows the resulting low resolution image of the reservoir after application of the grid based approach.

Figure 7:
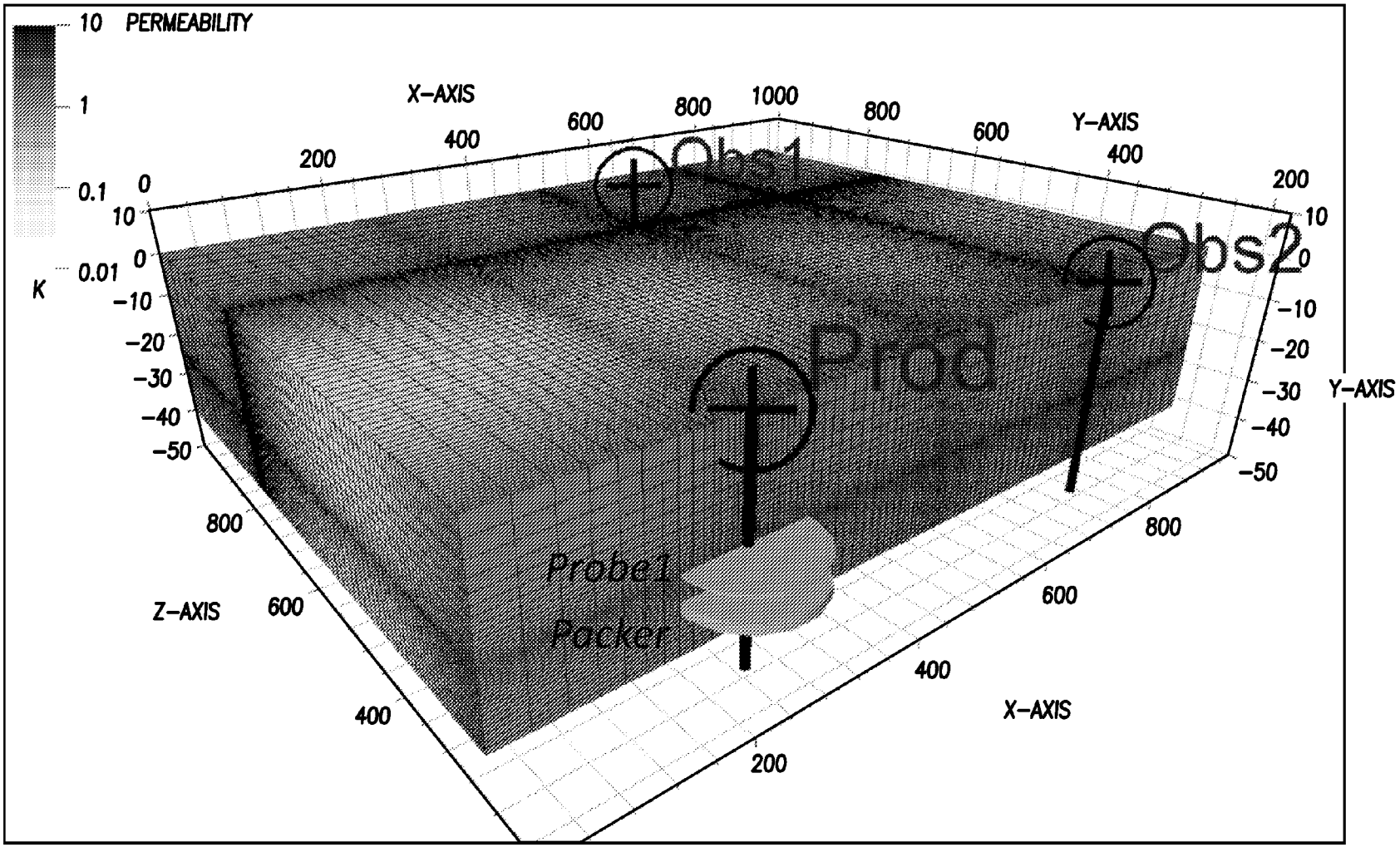
FIG. 7 illustrates a schematic cross-sectional view depicting a system to make distributed pressure measurements offset vertically from the production/injection zone.
Figure 8:
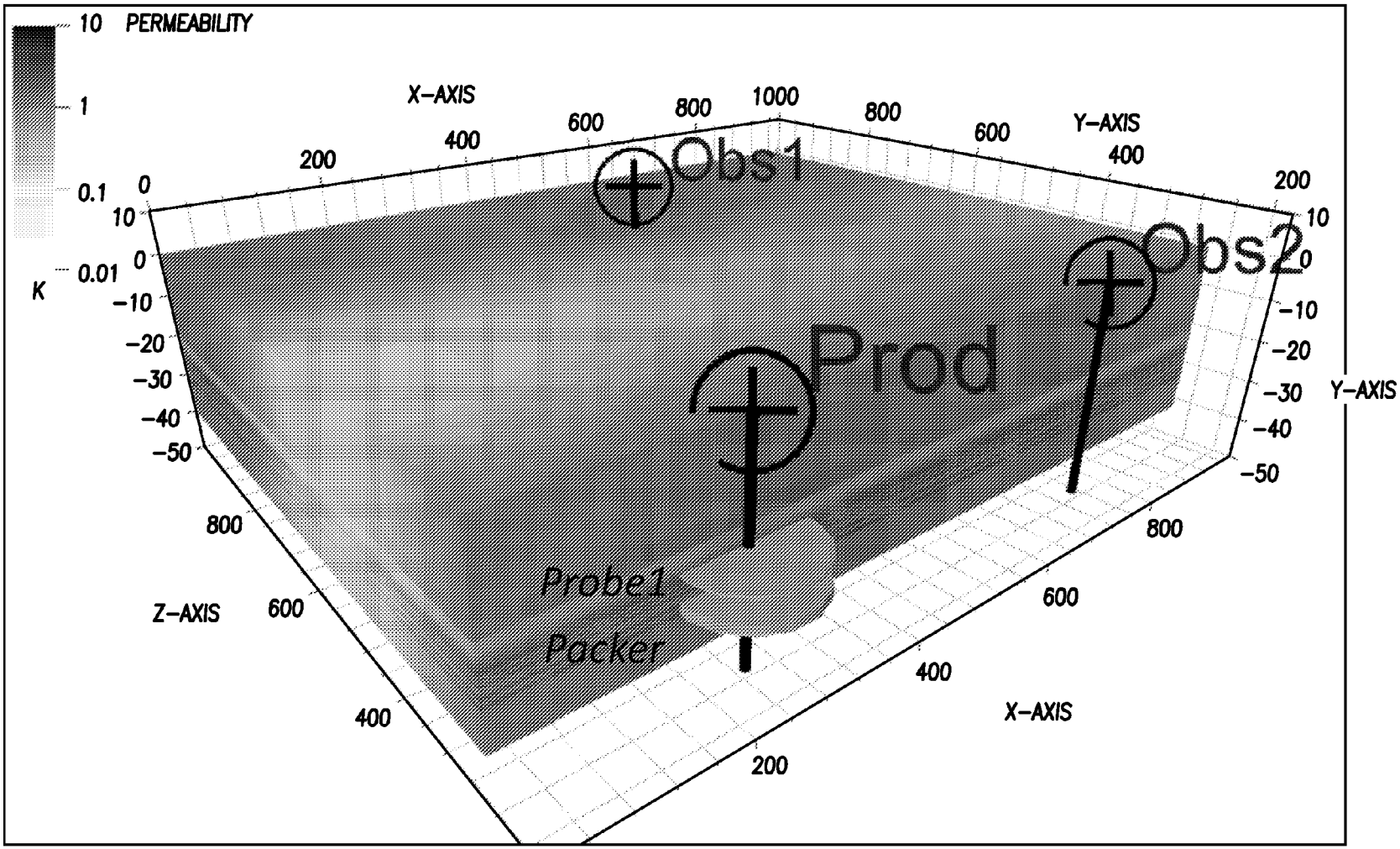
FIG. 8 illustrates a 3D low resolution image of the reservoir obtained by application of the first aspect of this invention to the measurement points shown in FIG. 7.

In FIG. 7 and FIG. 8 the performance of the grid-based algorithm is demonstrated in a vertical direction. The initial state and well positions are indicated in FIG. 7. Fluid is produced from well prod at a packer (denoted packer) and the pressure is observed at point probe1. To simulate the measurement noise that is present in real data, random noise with a known standard deviation is added to the data. FIG. 8 shows the exemplar low resolution image at meso scale of the reservoir resulting from application of the grid-based method at IPTT scales (a few feet to about 50).

Figure 9:
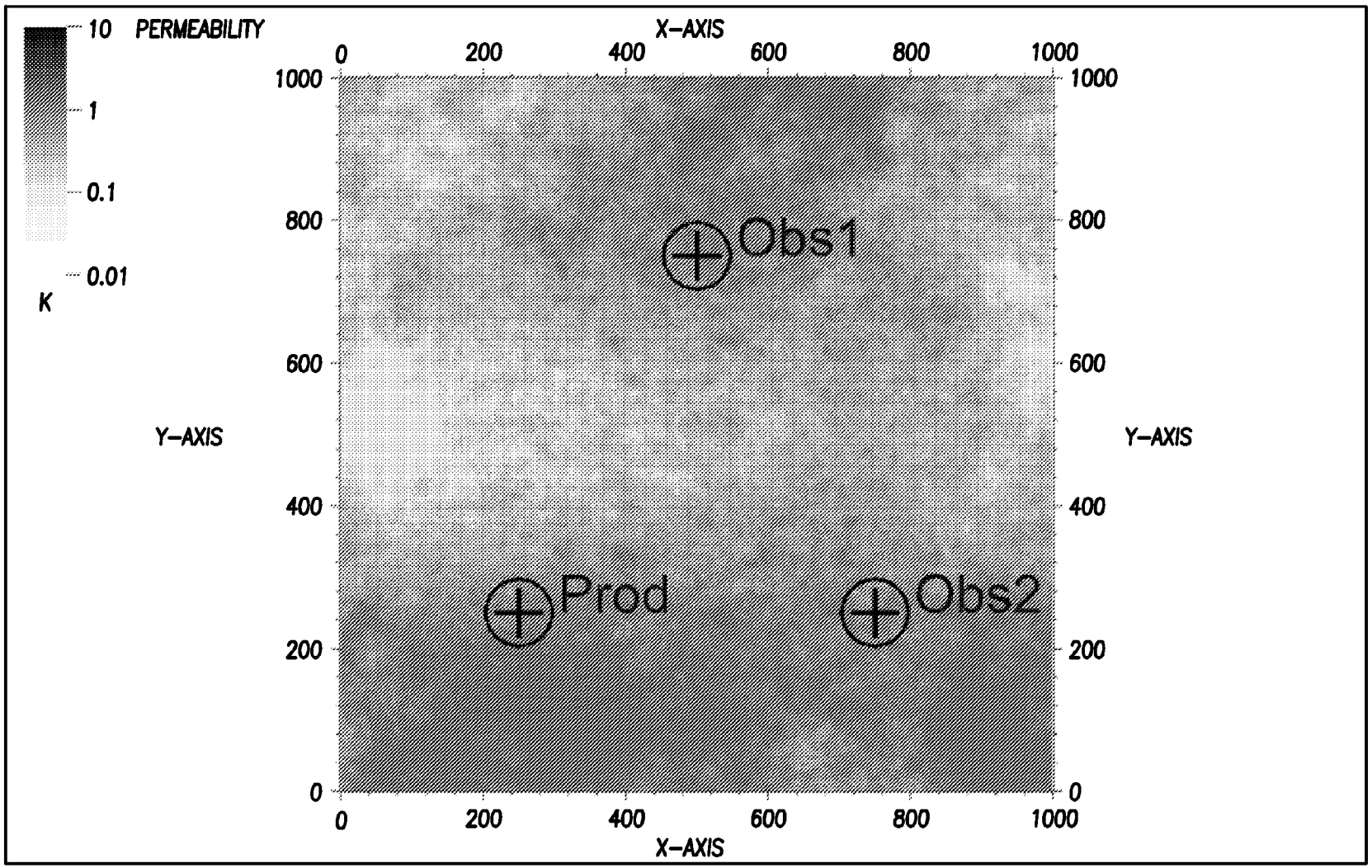
FIG. 9 illustrates an exemplary geological model conditioned to the pressure measurements obtained through application of the second aspect of the invention.
Figure 10:
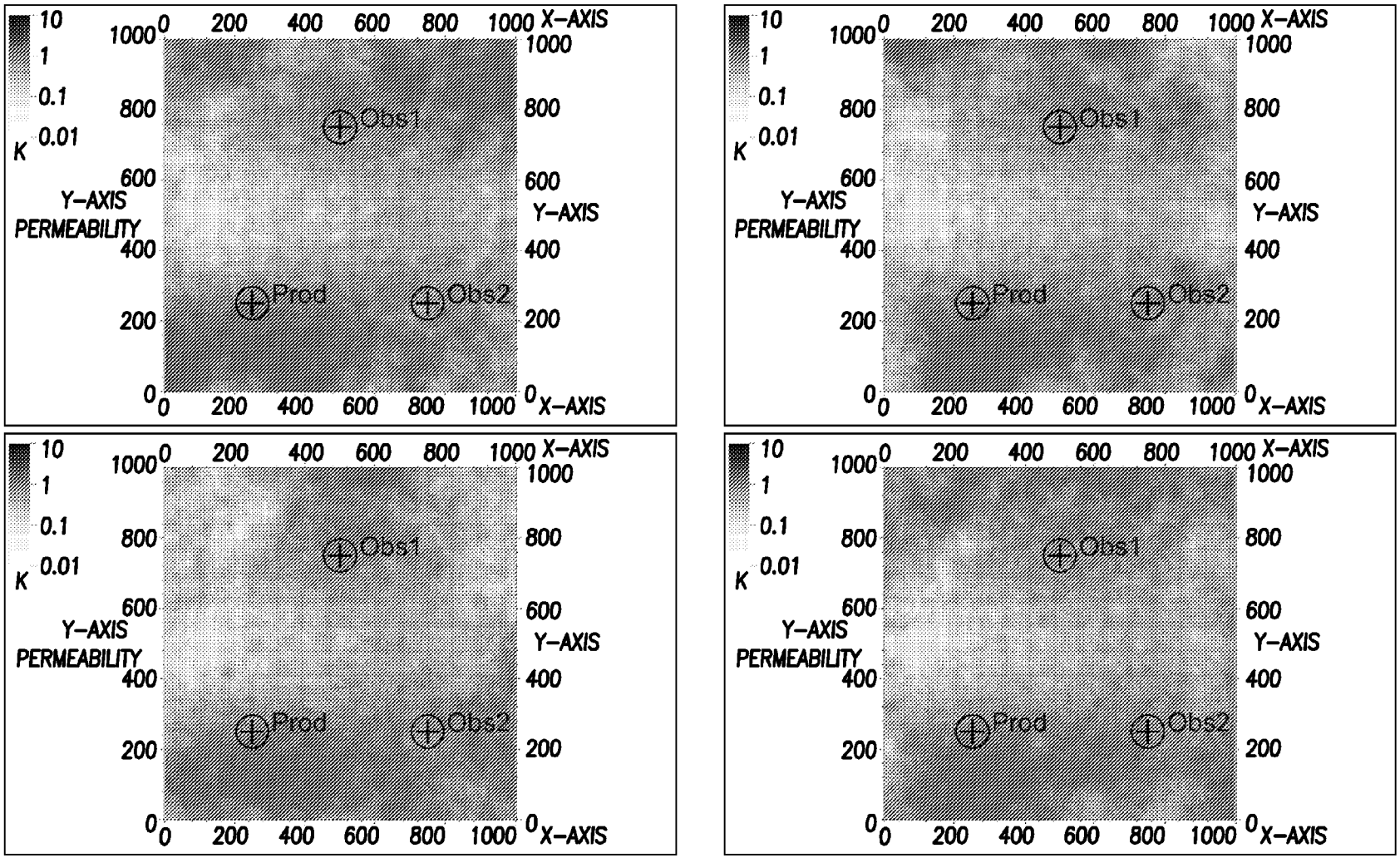
FIG. 10 illustrates the generation of multiple realizations of the geological model. Note the similarity between realizations in the near well areas due to the constraint of the pressure transient test/distributed pressure measurement data

In FIG. 9, the dynamic data conditioned model is downscaled to a geological grid by refining cells away from the wells. The resulting realization of the reservoir has fine scale detail based on geostatistical parameters (such as adding a nugget to the variogram). The realization is similar to the posterior mode of the grid based optimization where confidence is high. Multiple realizations of the model (FIG. 10) indicate that variability in cells conditioned by dynamic data is reduced but remains significant elsewhere.

Figure 11:
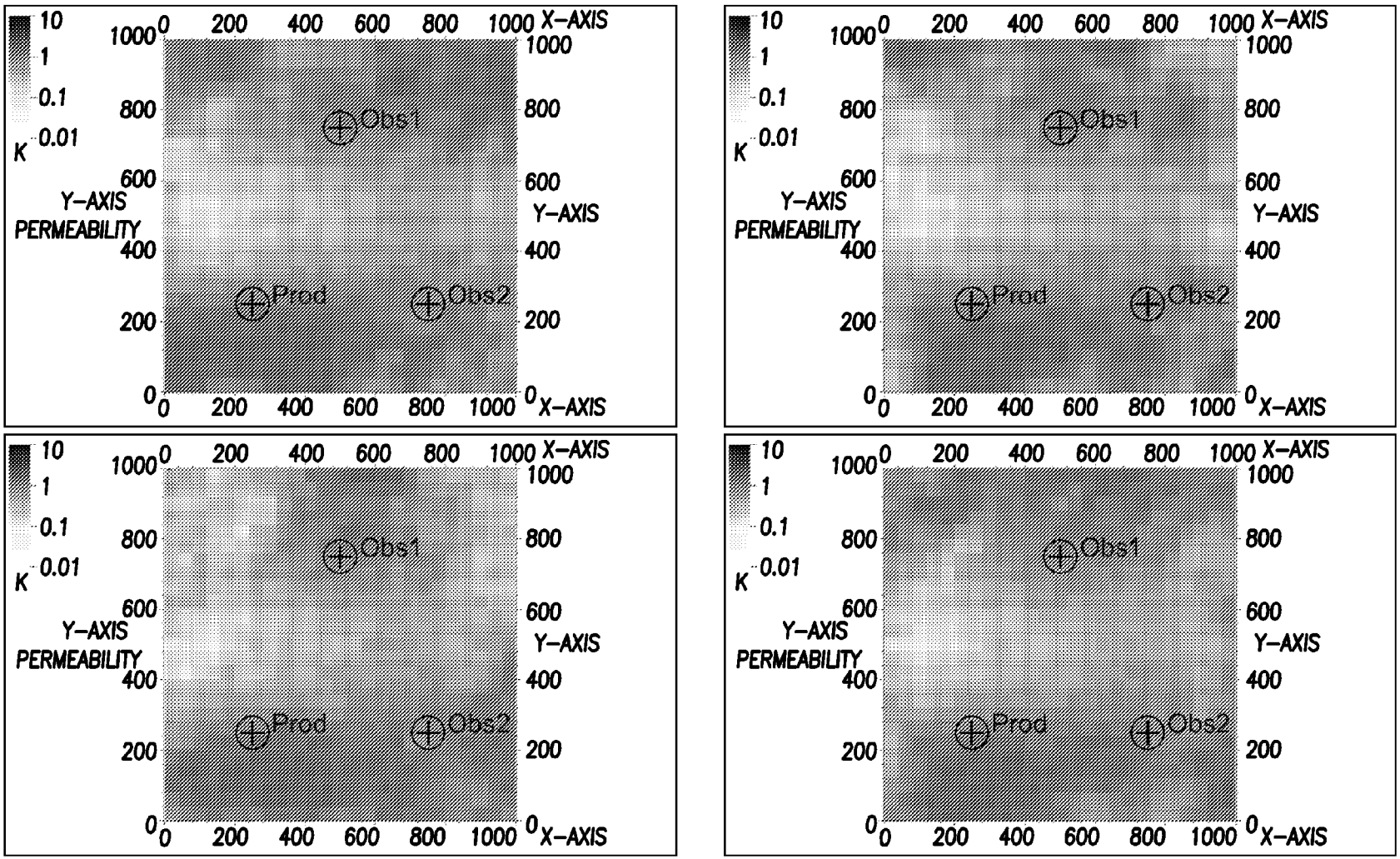
FIG. 11 illustrates the upscaled geological models.
Figure 12:
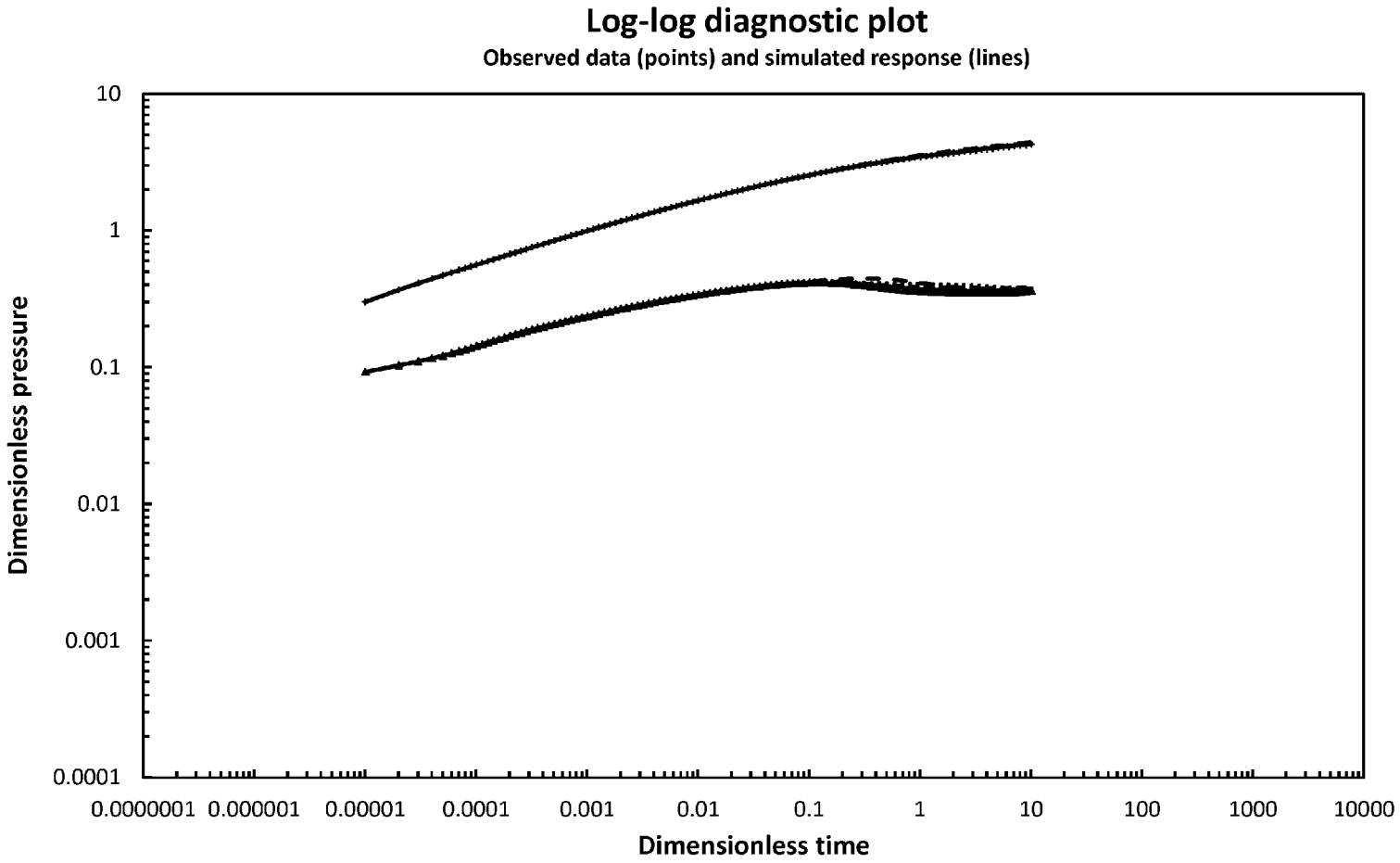

In FIG. 11, the P10, P50 and P90 volume cases are selected for upscaling. The pressure response resulting from a pressure transient test in well p is shown in FIG. 12. The original pressure transient test response is used to verify the model.

The inclusion of further data using Levenberg-Marquardt techniques is not included in this example but is considered an important part of overall workflow.

The invention claimed is:

1. A method for determining rock and fluid properties of a fluid-containing subsurface geological formation, comprising:

creating an initial, low resolution model of the geological formation from an initial lumped average parameter estimation derived from at least fluid pressure transient data obtained at selected points along a linear wellbore that traverses the formation;

creating a coarse scale grid-based parameter estimation model of the geological formation by combining the initial, low resolution model with data from at least one of seismic test results, formation logs, or basic geological structural information surrounding the linear wellbore;

creating a finer scale grid-based parameter estimation model of the geological formation in one or more selected areas of the coarse scale grid-based parameter estimation model by obtaining additional data at points within the geological formation and combining the resulting additional data points with the coarse scale grid-based parameter estimation model;

creating a structural model of the geological formation from the finer scale grid-based parameter estimation model by using geostatistical realization methods that are constrained by dynamic data points;

simulating from the structural model a simulated lumped average parameter estimation along the linear wellbore, and comparing the simulated lumped average parameter estimation with the initial lumped average parameter estimation to determine a confidence level in the structural model.

2. The method defined in claim 1, wherein the geostatistical realization methods are created by the application of local Gaussian fields.

3. The method defined in claim 1, wherein the initial lumped average parameter estimation is derived from nonlinear optimization.

4. The method defined in claim 1, wherein the additional data points used to create the finer scale grid-based parameter estimation model are derived from dynamic data.

5. The method defined in claim 1, wherein the finer scale grid-based parameter estimation model of the geological formation comprises a number of grid scales, and wherein creating the finer scale grid-based parameter estimation model further comprises increasing the number of grid cells.

6. The method defined in claim 1, wherein the geologic formation is a petroleum producing well, and wherein the method further comprises:

incorporating further data into the structural model at a later stage in field life of the well.

7. A non-transitory machine readable storage medium encoded with a computer program and executable by a computer to perform method steps for determining rock and fluid properties of a fluid-containing subsurface geological formation, the method steps comprising:

creating an initial, low resolution model of the geological formation from an initial lumped average parameter estimation derived from at least fluid pressure transient data obtained at selected points along a linear wellbore that traverses the formation;

creating a coarse scale grid-based parameter estimation model of the geological formation by combining the initial, low resolution model with data from at least one of seismic test results, formation logs, or basic geological structural information surrounding the linear wellbore;

creating a finer scale grid-based parameter estimation model of the geological formation in one or more selected areas of the coarse scale grid-based parameter estimation model by obtaining additional data at points within the geological formation and combining the resulting additional data points with the coarse scale grid-based parameter estimation model;

creating a structural model of the geological formation from the finer scale grid-based parameter estimation model by using geostatistical methods that are constrained by dynamic data points;

simulating from the structural model a simulated lumped average parameter estimation along the linear wellbore, and comparing the simulated lumped average parameter estimation with the actual initial lumped average parameter estimation to determine a confidence level in the structural model.

8. The non-transitory machine readable storage medium in claim 7, further comprising wherein the geostatistical realization methods are created by the application of local Gaussian fields.

9. The non-transitory machine readable storage medium in claim 7, further comprising wherein the initial lumped average parameter estimation is derived from non-linear optimization.

10. The non-transitory machine readable storage medium in claim 7, further comprising wherein the additional data points used to create said finer scale grid-based parameter estimation model are derived from dynamic data.

11. The non-transitory machine readable storage medium in claim 7, further comprising wherein the finer scale grid-based parameter estimation model of the geological formation comprises a number of grid scales, and wherein creating the finer scale grid-based parameter estimation model further comprises increasing the number of grid cells.

12. The non-transitory machine readable storage medium in claim 7, wherein the geologic formation is petroleum producing well, and wherein the method further comprises:

incorporating further data into the structural model at a later stage in field life of the well.

* * * * *